US010288227B2

(12) United States Patent
Van Dreumel et al.

(10) Patent No.: US 10,288,227 B2
(45) Date of Patent: May 14, 2019

(54) DIMABLE LIGHT EMITTING ARRANGEMENT

(71) Applicant: SIGNIFY HOLDING B.V., Eindhoven (NL)

(72) Inventors: Gerardus Wilhelmus Gerbe Van Dreumel, Nijmegen (NL); Egbert Lenderink, Waalre (NL); Hicham Sabir, Eindhoven (NL); Bijan Vatan Khah, Tilburg (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 14/772,792

(22) PCT Filed: Feb. 27, 2014

(86) PCT No.: PCT/IB2014/059285
§ 371 (c)(1),
(2) Date: Sep. 4, 2015

(87) PCT Pub. No.: WO2014/140976
PCT Pub. Date: Sep. 18, 2014

(65) Prior Publication Data

US 2016/0018069 A1 Jan. 21, 2016

Related U.S. Application Data

(60) Provisional application No. 61/775,976, filed on Mar. 11, 2013.

(51) Int. Cl.
*F21V 9/00* (2018.01)
*F21K 9/232* (2016.01)
(Continued)

(52) U.S. Cl.
CPC ..... *F21K 9/232* (2016.08); *F21K 9/62* (2016.08); *F21K 9/64* (2016.08); *H05B 33/0857* (2013.01);
(Continued)

(58) Field of Classification Search
CPC ..... F21K 9/64
See application file for complete search history.

(56) References Cited

U.S. PATENT DOCUMENTS 8,610,341 B2 * 12/2013 Dai ..... F21S 8/02 257/98
2002/0030862 A1 * 3/2002 Tabata ..... H04N 1/484 358/509
(Continued)

FOREIGN PATENT DOCUMENTS

JP 2012521066 A 9/2012
JP 2012199539 A 10/2012
(Continued)

*Primary Examiner* — Sean P Gramling
*Assistant Examiner* — Keith G. Delahoussaye
(74) *Attorney, Agent, or Firm* — Akarsh P. Belagodu

(57) ABSTRACT

A dimmable light emitting arrangement (100, 200, 300, 400) has a relatively low correlated color temperature in the dimmed state, and a relatively high and constant color rendering index. The dimmable light emitting arrangement (100, 200, 300, 400) comprises a first light source (10, 10*a*, 10*b*) adapted to emit light of a first wavelength range between 380 and 460 nm, a second light source (20, 20*a*, 20*b*) adapted to emit light of a second wavelength range between 570 and 610 nm, a first wavelength converting material (30), and a second wavelength converting material (40). The first wavelength converting material (30) receives light from the first light source (10, 10*a*, 10*b*) and converts light of the first wavelength range into light having an emission peak within a third wavelength range between 470 and 570 nm. The second wavelength converting material
(Continued)

(40) receives light from the first and second light sources, and converts light of the first wavelength range and light the second wavelength range into light having an emission peak within a fourth wavelength range between 590 and 630 nm.

11 Claims, 5 Drawing Sheets

(51) Int. Cl.

| | |
|---|---|
| ***H05B 33/08*** | (2006.01) |
| ***F21K 9/62*** | (2016.01) |
| ***F21K 9/64*** | (2016.01) |
| *F21Y 105/10* | (2016.01) |
| *F21Y 115/10* | (2016.01) |
| *F21Y 113/13* | (2016.01) |

(52) U.S. Cl.
CPC ..... *F21Y 2105/10* (2016.08); *F21Y 2113/13* (2016.08); *F21Y 2115/10* (2016.08)

(56) References Cited

U.S. PATENT DOCUMENTS

2004/0245532 A1* 12/2004 Maeda ..... C09K 11/7734 257/89
2007/0223219 A1* 9/2007 Medendorp, Jr. .... C09K 11/586 362/231
2007/0285000 A1* 12/2007 Lim ..... G02F 1/133603 313/501
2009/0095966 A1* 4/2009 Keller ..... C09K 11/7734 257/98
2011/0216522 A1* 9/2011 Harbers ..... F21K 9/50 362/84
2012/0104935 A1 5/2012 Haase
2012/0194068 A1 8/2012 Cheng
2013/0093362 A1* 4/2013 Edwards ..... H01L 25/0753 315/313
2013/0114242 A1* 5/2013 Pickard ..... H05B 33/0803 362/84
2014/0210332 A1* 7/2014 Zhang ..... F21K 9/135 313/46

FOREIGN PATENT DOCUMENTS

WO WO2010103480 A2 9/2010
WO WO2010122312 A1 10/2010
WO WO2012042415 A1 4/2012
WO WO2012146554 A1 11/2012

* cited by examiner

DIMABLE LIGHT EMITTING ARRANGEMENT

CROSS-REFERENCE TO PRIOR APPLICATIONS

This application is the U.S. National Phase application under 35 U.S.C. § 371 of International Application No. PCT/IB2014/059285, filed on Feb. 27, 2014, which claims the benefit of U.S. Patent Application Ser. No. 61/775,976, filed on Mar. 11, 2013. These applications are hereby incorporated by reference herein.

FIELD OF THE INVENTION

The present invention relates to a dimmable light emitting arrangement comprising a first light source, a second light source, a first wavelength converting material, and a second wavelength converting material. It further relates to a retrofit lamp or a luminaire comprising said dimmable light emitting arrangement.

BACKGROUND OF THE INVENTION

Nowadays, incandescent light sources are frequently substituted by light emitting arrangements based on solid state light sources. A light emitting arrangement based on a solid state light source, e.g. an LED, has many advantages over an incandescent light source, such as reduced power consumption, long service life, and environmental conservation. However, it is desirable that at least some features of traditional incandescent light sources are adopted by modern light emitting arrangements.

An incandescent light source is a light source that produces light from heat. An incandescent light source changes its color temperature from about 2700 K to about 1900 K, when dimmed from 100% light output to 5% light output. The so-called dimming curve of the light emitted from the incandescent light source ideally follows a planckian curve, also called blackbody curve, in a CIE chromaticity diagram. A lower color temperature makes the light appear more reddish to the human eye. Thus, a lower color temperature is associated with a warmer, cozier and pleasant atmosphere.

It would be desirable to provide a light emitting arrangement, based on a solid state light source, which mimics the behavior of an incandescent light source in the dimmed state, i.e. at low levels of luminous flux. Such behavior is advantageous e.g. when the light emitting arrangement is used in hospitality settings. Preferably, the correlated color temperature of the light emitted from a light emitting arrangement, based on a solid state light source, should also follow a planckian curve in a CIE chromaticity diagram.

WO 2010/103480 disclosed a lighting device comprising an LED driver, a two-terminal LED module, a first LED group and a second LED group, wherein the LED module was designed to vary the LED currents to the first LED group and the second LED group, respectively, such that the color behavior of the light output of the LED module on dimming resembled the color behavior of an incandescent lamp.

However, there is still a need in the art for light emitting arrangements having a relatively low correlated color temperature, similar to the color temperature of an incandescent light source, in the dimmed state, and having a relatively high and constant color rendering index, close to the color rendering index of an incandescent light source.

SUMMARY OF THE INVENTION

It is an object of the present invention to at least partly overcome the problems in the prior art, and to provide a dimmable light emitting arrangement having a relatively low correlated color temperature in the dimmed state, and a relatively high and constant color rendering index.

According to a first aspect of the invention, this and other objects are achieved by a dimmable light emitting arrangement comprising a first light source, a second light source, a first wavelength converting material and a second wavelength converting material. The first light source is adapted to emit light of a first wavelength range between 380 and 460 nm. The second light source is adapted to emit light of a second wavelength range between 570 and 610 nm. The first wavelength converting material is arranged to receive light emitted from the first light source, and is capable of converting the light of the first wavelength into light having an emission peak within a third wavelength range between 470 and 570 nm. The second wavelength converting material is arranged to receive light emitted from the first light source and light emitted from the second light source, and is capable of converting the light of the first wavelength range and the light of the second wavelength range into light having an emission peak within a fourth wavelength range between 590 and 630 nm.

Optionally, the second wavelength converting material may also be capable of converting light of the third wavelength range, typically into light having an emission peak within the fourth wavelength range.

Advantageously, the dimmable light emitting arrangement according to the present invention allows for a satisfactory red rendering in the dimmed state (i.e. a relatively low correlated color temperature at relatively low levels of luminous flux) as well as a relatively high and constant color rendering index at all levels of luminous flux. Another advantage of the dimmable light emitting arrangement of the present invention is that it may provide high luminous efficacy, expressed in lumen per watt (lm/W), compared to the prior art, and hence can be more energy efficient.

Further, another advantage of the dimmable light emitting arrangement is that low cost electronics may be used. By using a phosphor converted LED instead of a direct red LED, less complex electronics can be used.

The dimmable light emitting arrangement according to the present invention may mimic the behavior of an incandescent light source in the dimmed state. A satisfactory red rendering in the dimmed state is achieved by allowing wavelengths corresponding to reddish light be emitted at relatively high intensity at relatively low levels of luminous flux. Hence, the dimmable light emitting arrangement is suitable for use in many applications, e.g. hospitality settings.

According to an embodiment, the second wavelength converting material has a Stokes shift of 150 nm or less, e.g. 100 nm or less, or 50 nm or less. Typically the Stokes shift may be in the range between 25 nm and 150 nm, between 25 and 100 nm or between 25 and 50 nm. A second wavelength converting material having such a small Stokes shift may convert both light of the first wavelength range and light of the second wavelength range into light having an emission peak within the fourth wavelength range between 590 and 630 nm.

According to an embodiment, the second wavelength converting material is a red organic wavelength converting material. A red organic wavelength converting material may be capable of converting both light of the first wavelength range and light of the second wavelength range into light having an emission peak within the fourth wavelength range between 590 and 630 nm.

According to an embodiment, the second wavelength converting material is arranged remotely from the first light source and the second light source. Such an arrangement allows for crosstalk between the light sources. In other words, in such an arrangement the second wavelength converting material may typically receive light emitted from both the first light source and the second light source. Optionally, the second wavelength converting material may also receive light converted by the first wavelength converting material.

According to an embodiment, the first wavelength converting material is arranged remotely from the first light source.

According to an embodiment, the dimmable light emitting arrangement further comprises a wavelength converting member comprising the first wavelength converting material and the second wavelength converting material.

Such a wavelength converting member may be arranged remotely from the first light source and the second light source. An advantage of having a wavelength converting member comprising both the first and the second wavelength converting materials is that the wavelength converting member may easily be arranged to cover both the first light source and the second light source. Further, the wavelength converting member may be arranged to cover at least one of a plurality of the first light source and a plurality of the second light source.

According to an embodiment, the wavelength converting member is arranged to receive light emitted by the first light source, and the dimmable light emitting arrangement further comprises a second wavelength converting member comprising the second wavelength converting material, the second wavelength converting member being arranged to receive light emitted by the second light source.

The wavelength converting member comprising the first wavelength converting material and the second wavelength converting material, and arranged to receive light emitted by the first light source may be arranged in direct contact with, in the vicinity of, or remotely from the first light source. The wavelength converting member may be in the shape of e.g. a film, a plate or a dome.

The second wavelength converting member comprising the second wavelength converting material, and arranged to receive light emitted by the second light source may be arranged in direct contact with, in the vicinity of, or remotely from the second light source. The second wavelength converting member may be in the shape of e.g. a film, a plate or a dome.

According to an embodiment, the dimmable light emitting arrangement further comprises a light mixing chamber. The first light source and the second light source are arranged inside the light mixing chamber.

The light mixing chamber may comprise a light exit window. Preferably, the first light source and the second light source are arranged such that they are facing the light exit window.

According to an embodiment, at least the second wavelength converting material is arranged in an exit window of the light mixing chamber.

Optionally, the light exit window may also comprise the first wavelength converting material.

According to an embodiment, each of the first light source and the second light source comprises at least one solid state light source. The at least one solid state light source may typically be a light emitting diode (LED).

According to an embodiment, the first light source comprises at least one blue LED or UV LED, e.g. a royal blue LED. The first light source may be a blue direct emitting LED. Alternatively the first light source may be a blue phosphor-converted LED, typically comprising a UV emitting LED chip and a blue phosphor to for converting the UV light into blue light. Preferably, the first light source comprises at least one blue LED.

According to an embodiment, the second light source comprises at least one phosphor-converted amber LED. Phosphor-converted amber LEDs are typically blue-shifted in comparison to direct red LEDs, which allow the light emitted from the phosphor-converted amber LEDs to be converted by the second wavelength converting material.

A phosphor-converted LED generally refers to an LED comprising a wavelength converting material provided directly on top of the LED chip in order to produce converted light which, possibly in combination with any transmitted light, results in the desired color (e.g., amber for a phosphor-converted amber LED). In contrast, a "direct LED" refers to an LED chip emitting the desired color directly (e.g. red for a direct red LED).

According to another aspect of the invention, a retrofit lamp comprising the dimmable light emitting arrangement is provided. Such a lamp may also be dimmable.

According to another aspect of the invention, a luminaire comprising the dimmable light emitting arrangement is provided. Such a luminaire may also be dimmable.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

Figure 1:
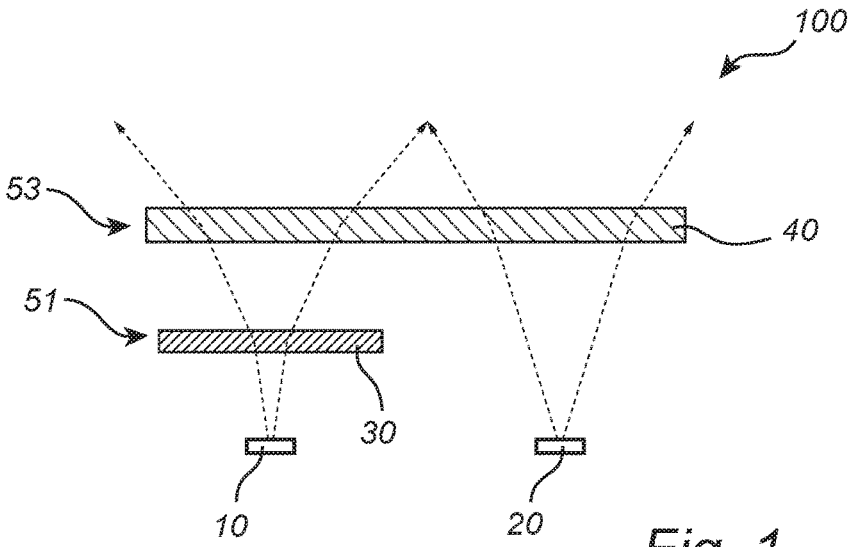
FIG. 1 shows a dimmable light emitting arrangement according to an embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

By the term "color temperature" is meant a numeric value representing chroma of a light source. Color temperature indicates the color of an object that reflects no light whatsoever, i.e. a black body, if heated to a certain temperature. The unit of color temperature is Kelvin (K). The color temperature of reddish colors is relatively low. The color temperature of bluish colors is relatively high.

By the term "correlated color temperature" (CCT) is meant a numeric value that relates the appearance of a light source to the appearance of a theoretical black body heated to a certain temperature. The CCT of a light source, given in Kelvin (K), is the temperature at which the heated blackbody most closely matches the color of the light source in question. The CCT characterizes the color of the emitted light.

By the term "color rendering index" (CRI) is meant a measure of fidelity, i.e., how "true" a light source is when compared to the reference source. The CRI is a reference-based metric, and the CRI value is estimated by utilizing eight standard color samples having moderate lightness and being of approximately equal difference in hue, i.e. equal spacing on a chromaticity diagram. Optionally, six special color samples may also be utilized. For each color sample, the chromaticity under a light source for which the CRI is to be defined can be compared to the chromaticity under a reference source of equal CCT. The measurement of color difference between the light source and the reference source for each color sample is then mathematically adjusted and subtracted from 100 ($R_i$). The CRI, which averages the $R_i$ scores for the eight standard test colors, typically has a range between 0 and 100. A score of 100 indicates that the source renders colors in a manner identical to the reference.

By the term "luminous flux" is meant a quantitative expression of the brilliance of a source of visible light, wherein visible light is the electromagnetic energy within the wavelength range between approximately 390 nm and approximately 770 nm. The luminous flux, also called luminous power, is the measure of the perceived power of light and is adjusted to reflect the varying sensitivity of the human eye to different wavelengths of light. The standard unit of luminous flux is the lumen (lm).

By the term "planckian curve", also called Planck curve or blackbody curve, is meant the characteristic way in which the intensity of radiation emitted by a hot object depends on frequency. The frequency at which the emitted intensity is the highest is an indication of the temperature of the radiating object.

By the term "CIE chromaticity diagram" is meant a triangular graph, on which points for all chromaticity coordinates may be systematically plotted, the apexes of the triangle representing the primary colors. It is a tool to specify how the human eye will experience light with a given spectrum. Chromaticity coordinates define a specific color by its position in a corresponding color space diagram.

By the term "incandescent light source" is meant a light source which produces light from heat.

By the term "Stokes shift" is meant the difference (in wavelength or frequency units) between spectral positions of the band maxima of the absorption and emission spectra (fluorescence and Raman being two examples) arising from the same electronic transition. The larger the Stokes shift, the more energy dissipates.

The present invention relates to a dimmable light emitting arrangement.

FIG. 1 schematically shows a dimmable light emitting arrangement 100 according to an embodiment of the present invention, comprising a first light source 10, a second light source 20, a first wavelength converting material 30, and a second wavelength converting material 40.

The first light source 10 may be one single light source, or a plurality of light sources. Such a plurality of light sources may be arranged in a single set. The first light source may be a solid state light source, e.g. an LED. For instance, the first light source may be a blue LED or a UV LED. The first light source may be a blue direct emitting LED. Alternatively the first light source may be a blue phosphor-converted LED, typically comprising a UV emitting LED chip and a blue phosphor to for converting the UV light into blue light. Preferably, the first light source is a blue LED.

In FIG. 1, the first light source is a single LED 10.

The first light source 10 is adapted to emit light of a first wavelength range, which may be between 380 and 460 nm. Typically, the light of the first wavelength range appears blue or violet to the human eye.

The second light source 20 may be one single light source or a plurality of light sources. Such a plurality of light sources may be arranged in a single set. The second light source may be a solid state light source, e.g. an LED. For instance, the second light source may be a direct amber LED or a phosphor-converted amber LED. Preferably, the second light source is a phosphor-converted amber LED.

A direct amber LED emits light appearing amber to the human eye from a light active layer of the LED.

In contrast, in a phosphor-converted amber LED, the active layer of the LED emits light of a wavelength being shorter than a wavelength corresponding to amber light. A wavelength converting material, e.g. a phosphor, is arranged directly on top of the LED chip to receive and convert the light of the shorter wavelength to another wavelength. The wavelength converting material emits light appearing amber to the human eye. Typically, the wavelength converting material is arranged in direct contact with the LED.

In FIG. 1, the second light source is a single LED 20.

The second light source is adapted to emit light of a second wavelength range, which may be ranging between 570 and 610 nm. Typically, the light of the second wavelength range appears amber or orange to the human eye.

The first wavelength converting material 30 may be a yellow wavelength converting material, a green wavelength converting material, or a yellow-green wavelength converting material. Examples of such wavelength converting materials are $(Lu_{1-x-y-a-b}Y_xGd_y)_3(Al_{1-z-u}Ga_zSi_u)_5O_{12-u}N_u$:$Ce_aPr_b$, wherein $0 \le x \le 1$, $0 \le y \le 1$, $0 < z \le 0.1$, $0 \le u \le 0.2$, $0 < a \le 0.2$ and $0 < b \le 0.1$, such as $Lu_3Al_5O_{12}:Ce^{3+}$ (LuAG) and $Y_3Al_5O_{12}:Ce^{3+}$ (YAG), $(Sr_{1-a-b}Ca_bBa_c)Si_xN_yO_z:Eu_a^{2+}$ wherein a=0.002-0.2, b=0.0-0.25, c=0.0-1.0, x=1.5-2.5, y=0.67–2.5, z=1.5-4.

Further, examples of such wavelength converting materials include e.g. $SrSi_2N_2O_2:Eu^{2+}$ and $BaSi_2N_{0.67}O_4:Eu^{2+}$, $(Sr_{1-u-v-x}Mg_uCa_vBa_x)(Ga_{2-y-z}Al_yIn_z\ S_4):Eu^{2+}$, including e.g. $SrGa_2S_4:Eu^{2+}$, $(Sr_1,Ba_x)_2SiO_4:Eu$, wherein $0 < x \le 1$, including e.g. $BaSrSiO_4:Eu^{2+}$ $(Ca_{1-x-y-a-b}Y_xLu_y)_3(Sc_{1-z}Al_z)_2(Si_{1-x-y}Al_{x+})_3O_{12}:Ce_aPr_b$, wherein $0 \le x \le 1$, $0 \le y \le 1$, $0 < z \le 1$, $0 \le u \le 0.2$, $0 \le a \le 0.2$ and $0 \le b \le 0.1$, such as $Ca_3Sc_2Si_3O_{12}:Ce^{3+}$,$Ba_3Si_6O_{15-3x}N_{2x}$, including e.g. $Ba_3Si_6O_{12}N_2:Eu^{2+}$ (Full Width at Half Maximum (FWHM)=68 nm). LuAG is an example of a green wavelength converting material and YAG is an example of a yellow wavelength converting material. These materials are usually doped, typically with cerium (Ce).

The first wavelength converting material may be LuAG (Ce 1.5%).

The first wavelength converting material may be arranged in direct contact with, in the vicinity of, or remotely from the first light source. Preferably, a wavelength converting member comprises the first wavelength converting material.

In FIG. 1, a first wavelength converting member 51 comprises the first wavelength converting material 30 and is arranged remotely from the first light source 10.

The first wavelength converting material 30 is typically arranged to receive light emitted from the first light source 10. The first wavelength converting material is capable of converting the light of the first wavelength range into light having an emission peak within a third wavelength range, which may be ranging between 470 and 570 nm. Typically, the light having an emission peak within the third wavelength range appears yellow or green to the human eye.

Preferably, a wavelength converting member comprising the first wavelength converting material is translucent at least to light having an emission peak within the third wavelength range. However, preferably, the wavelength converting member comprising the first wavelength converting material may also transmit a portion of the light of the first wavelength range.

The second wavelength converting material 40 may be a red wavelength converting material, typically a red organic wavelength converting material. The second wavelength converting material may have a Stokes shift of 150 nm or less as described above, e.g. within a range between 25 and 150 nm. The red wavelength converting material may comprise a red light emitting perylene material. An example of such red light emitting perylene material is Lumogen F305 (BASF), which has an absorption maximum at 578 nm and an emission maximum at 613 nm.

The second wavelength converting material 40 may be arranged remotely from the first light source 10 and the second light source 20. The second wavelength converting material may be comprised within or form part of a wavelength converting member. A wavelength converting member comprising the second wavelength converting material may also comprise at least part of the first wavelength converting material.

As shown in FIG. 1, a second wavelength converting member 53 comprises the second wavelength converting material 40 and is arranged remotely from the first light source 10 and from the second light source 20. The second wavelength converting member 53 comprising the second wavelength converting material 30 is arranged downstream of the first wavelength converting member 51 comprising the first wavelength converting material 30, as seen in the path of light emitted from the first light source 10 and from the second light source 20.

In embodiments of the invention, a wavelength converting member comprising a second wavelength converting material may be arranged to receive light emitted from both the first light source 10 and from the second light source 20, thus being common to both the first and the second light sources 10, 20. Alternatively, respective individual second wavelength converting members comprising a second wavelength converting material may be associated with each of the first light source 10 and the second light source 20.

In FIG. 1, the second wavelength converting member 53 comprising the second wavelength converting material 40 is arranged to receive light from both the first light source 10 and the second light source 20. Thus, this second wavelength converting member 53 may be seen as a wavelength converting member that is common to both the first light source 10 and the second light source 20.

In FIG. 1, a first wavelength converting member 51 comprising a first wavelength converting material 30 is arranged to receive light primarily from the first light source 10. Thus, this first wavelength converting member 51 may be seen as an independent, individual wavelength converting member for the first light source 10.

The second wavelength converting material 40 is typically arranged to receive light emitted from the first light source 10 as well as light emitted from the second light source 20, and is capable of converting light of the first wavelength range and light of the second wavelength range into light having an emission peak within a fourth wavelength range, which may be ranging between 590 and 630 nm. The second wavelength converting material 40 may also be arranged to receive light emitted from the first wavelength converting material 30, and optionally, be capable of converting this light, typically having an emission peak within the third wavelength range mentioned above, into light having an emission peak within the fourth wavelength range. Typically, the light having an emission peak within the fourth wavelength range appears red or orange to the human eye.

Preferably, a wavelength converting member comprising the second wavelength converting material 40 is translucent at least to light having an emission peak within the fourth wavelength range. However, preferably, the wavelength converting member comprising the second wavelength converting material 40 may also transmit a portion of the light of the first wavelength range, the light of the second wavelength range and light having an emission peak within the third wavelength range.

A wavelength converting member may have any suitable shape. For example, each of the first and/or the second wavelength converting member 51, 53 may independently be a sheet, a film, a plate, a dome, and a film. A wavelength converting member may have any suitable shape and dimensions.

In embodiments of the invention using a wavelength converting member, at least one wavelength converting material may be comprised within the wavelength converting member. Alternatively, one or more wavelength converting material(s) may be applied (e.g., coated) on the wavelength converting member to form one or more layers. In both the former case and the latter case, the wavelength converting member is considered to comprise the wavelength converting material.

In some embodiments, the first light source comprises a plurality of light sources arranged in a first set, and the second light source comprises a plurality of light sources arranged in a second set, said first set and said second set may be arranged in series or in parallel. In a dimmable light emitting arrangement according to said embodiments, the current through the first light source, e.g. the first set, may be different from the current through the second light source, e.g. the second set. Both the current through the first light source and the current through the second light source may be varied over time.

In the following embodiments, the first and second light sources and the first and second wavelength converting materials may be as described above unless expressly stated otherwise.

Figure 2:
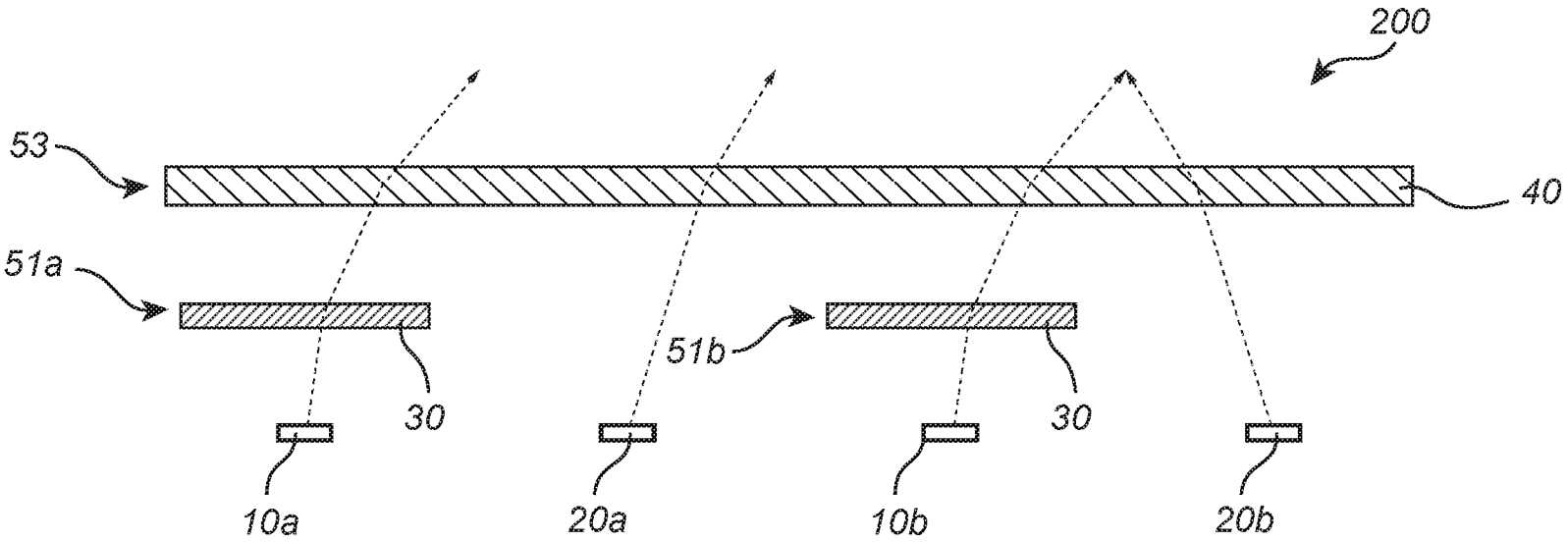
FIG. 2 shows a dimmable light emitting arrangement comprising a wavelength converting member according to an embodiment of the present invention.

In FIG. 2, a dimmable light emitting arrangement 200 comprising first light sources 10*a*, 10*b*, second light sources 20*a*, 20*b*, a first wavelength converting material 30 and a second wavelength converting material 40, is shown. In this embodiment, the first light source and the second light source each comprise a plurality of two light sources. The first light source here comprises LED 10*a* and LED 10*b*. The second light source comprises LED 20*a* and LED 20*b*. Remotely from each of the first light sources 10*a*, 10*b*, two respective wavelength converting members 51*a*, 51*b*, are arranged, each comprising the first wavelength converting material 30, to receive convert light of the first wavelength range into light having an emission peak within the third wavelength range. Preferably, the wavelength converting members 51*a*, 51*b* comprising the first wavelength converting material 30 are translucent at least to light of the third wavelength range. However, preferably, the wavelength converting members 51*a*, 51*b* may also transmit a portion of the light of the first wavelength range.

Further, a second wavelength converting member 53 comprising the second wavelength converting material 40 is arranged remotely from the first two light sources 10*a*, 10*b*, the second two light sources 20*a*, 20*b* and the two wavelength converting members 51*a*, 51*b* comprising the first wavelength converting material 30. The second wavelength converting member 53 comprising the second wavelength converting material 40 is arranged to receive, and is capable of converting, light of the first wavelength range, light of the second wavelength range and, optionally, light of the third wavelength range, into light having an emission peak within the fourth wavelength range.

The second wavelength converting member 53 comprising the second wavelength converting material 40 is arranged downstream of the wavelength converting members 51*a*, 51*b* comprising the first wavelength converting material 30, as seen in the path of light emitted from the first two light sources 10*a*, 10*b* and the second two light sources 20*a*, 20*b*.

The dimmable light emitting arrangement may further comprise a light mixing chamber. Preferably, the first light source and the second light source are arranged inside said light mixing chamber.

Figure 3:
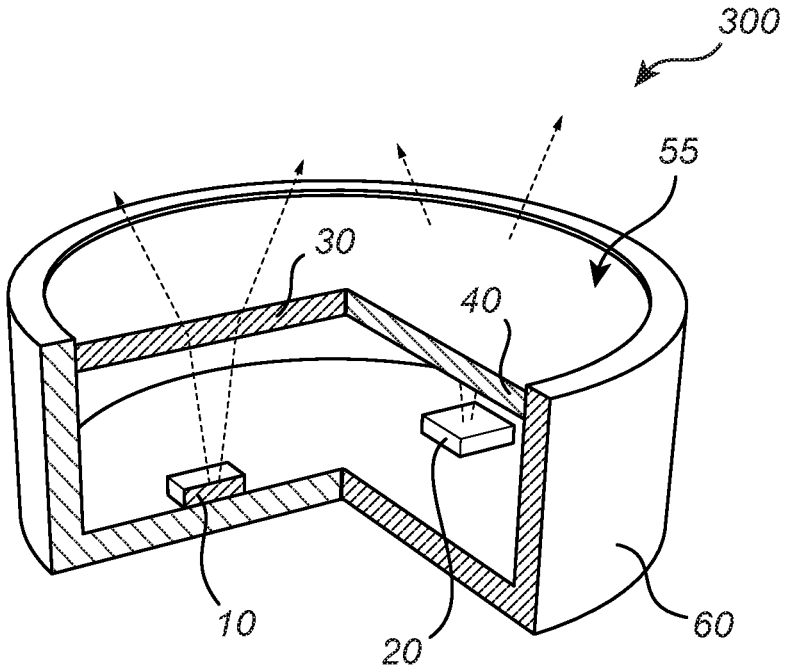
FIG. 3 shows a dimmable light emitting arrangement comprising a light mixing chamber according to an embodiment of the present invention.

FIG. 3 shows a dimmable light emitting arrangement 300 comprising a first light source 10, a second light source 20, a light mixing chamber 60, and a light exit window. The light mixing chamber is defined by a reflective support or bottom portion, at least one reflective side wall, and a light exit window opposite the bottom portion. Both the first wavelength converting material 30 and the second wavelength converting material 40 are arranged in the light exit window, in the form of a wavelength converting member 55 comprising both wavelength converting materials 30, 40. In an alternative embodiment, the wavelength converting member 55 may comprise the second wavelength converting material 40, but not the first wavelength material 30.

In FIG. 3, the first light source 10 and the second light source 20 are arranged on the bottom of the light mixing chamber 60. Typically the light exit window comprising the wavelength converting member 55 faces the first light source 10 and the second light source 20.

The first wavelength converting material 30 is arranged in said light exit window to receive and convert light of the first wavelength range. The second wavelength converting material 40 is arranged in said light exit window to at least receive and convert light of the first wavelength range and light of the second wavelength range.

In some embodiments, a respective individual wavelength converting member comprising a second wavelength converting material may be associated with each of the first light source and the second light source, such that one individual wavelength converting member comprising the second wavelength converting material is arranged to mainly receive light emitted from the first light source and another individual wavelength converting member comprising the second wavelength converting material is arranged to mainly receive light from the second light source. In such embodiments, the wavelength converting member arranged independently for the first light source may comprise both a first wavelength converting material and a second wavelength converting material.

Figure 4:
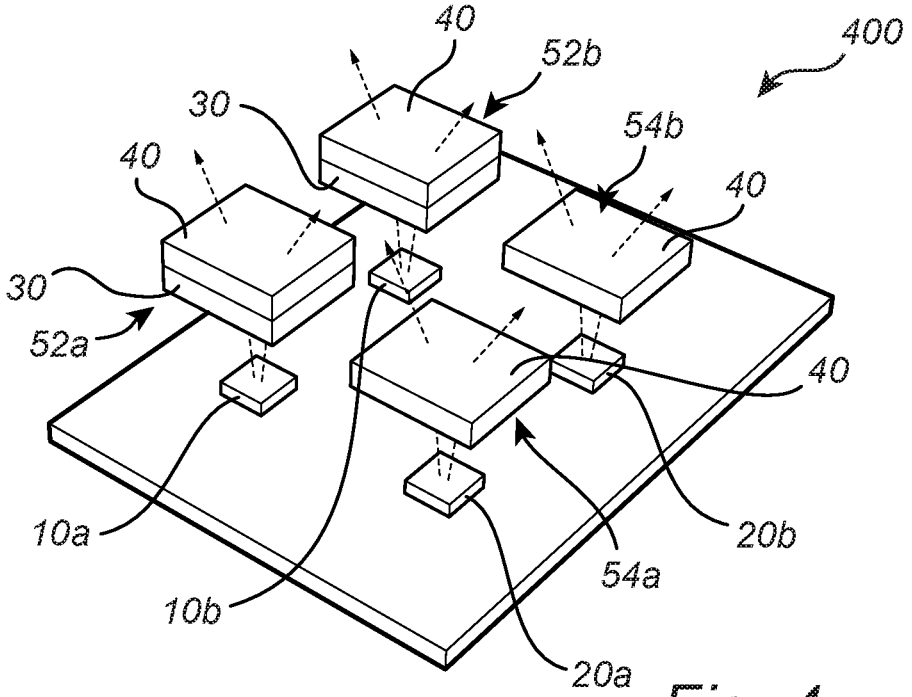
FIG. 4 shows a dimmable light emitting arrangement comprising several wavelength converting members according to an embodiment of the present invention.

FIG. 4 shows a dimmable light emitting arrangement 400 comprising first light sources, in this case LEDs, 10*a*, 10*b*, second light sources, in this case LEDs, 20*a*, 20*b*, a first wavelength converting material 30 and a second wavelength converting material 40.

A wavelength converting member 52*a* comprising a first wavelength converting material 30 and a second wavelength converting material 40 is arranged in a remote position to receive light from the first light source 10*a*. Another wavelength converting member 52*b*, also comprising a first wavelength converting material 30 and a second wavelength converting material 40, is arranged in a remote position to receive light from the light source 10*b*. The two respective wavelength converting members 52*a*, 52*b* are arranged such that the first wavelength converting material 30 may receive and convert light of the first wavelength range.

Further, a wavelength converting member 54*a* comprising second wavelength converting material 40 is arranged in a remote position to receive light from the light source 20*a*. Another wavelength converting member 54*b*, also comprising second wavelength converting material 40, is arranged in a remote position to receive light from the light source 20*b*.

Hence, in this embodiment, wavelength converting material 40 may receive and convert light of both the first and the second wavelength ranges.

In FIG. 4, all of the wavelength converting members 52*a*, 52*b*, 54*a*, 54*b* are arranged at approximately the same distance from their respective light sources 10*a*, 10*b*, 20*a*, 20*b* in the direction of the light emitted from the respective light source. However, the second wavelength converting material 40 may be arranged downstream of the first wavelength converting material 30 in the path of light emitted from the first light source 10*a* or 10*b* respectively.

The electronics of the dimmable light emitting arrangement according to the present invention may be low cost electronics, excluding expensive direct red LEDs and excluding complex electronics. Examples of complex electronics which may be excluded are an intelligent control and a feedback sensor. The electronics that may be used is similar to the electronics described in WO 2010/103480 A2, in particular at page 6, lines 3 to page 7, lines 10.

Typically, the electronics of the dimmable light emitting arrangement may comprise a dimmable current source, and an LED module comprising (at least) two terminals. In addition to the first light source and the second light source, the LED module may further comprise an electronic division circuit. The electronic division circuit may typically be connected to, or comprise, current sensor means and a memory.

EXAMPLES

The inventors investigated the color rendering index (CRI) and the correlated color temperature (CCT) for a dimmable light emitting arrangement.

A dimmable light emitting arrangement according to an embodiment of the present invention was investigated. The dimmable light emitting arrangement comprised a blue LED as the first light source, a phosphor-converted amber LED as the second light source, and a wavelength converting member comprising both LuAG (Ce 1.5%) as the first wavelength converting material and Lumogen F305 (BASF) as the second wavelength converting material. The wavelength converting member was arranged remotely from both the first light source and the second light source.

Figure 5:
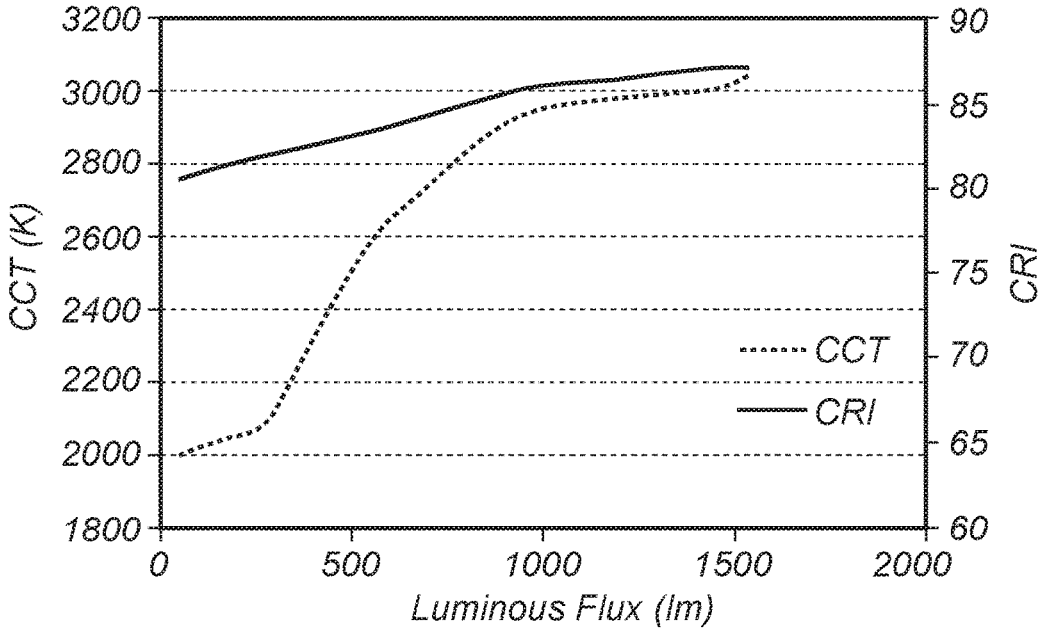
FIG. 5 shows the color rendering index (CRI) and the correlated color temperature (CCT) for a dimmable light emitting arrangement according to an embodiment of the present invention.

FIG. 5 shows the color rendering index (CRI) and the correlated color temperature (CCT) for the dimmable light emitting arrangement. Both the color rendering index and the correlated color temperature are each a function of luminous flux.

The light emitted from the light emitting arrangement has a color rendering index of approximately 80 at a relatively low luminous flux of approximately 50 lm, and a color rendering index of approximately 87 at a relatively high luminous flux of approximately 1600 lm. Thus, the color rendering index is relatively constant within the range of luminous flux from 50 lm to 1600 lm. The present invention mimics the behavior of incandescent light sources, keeping a high CRI (>80) at all lumen output (i.e. color temperatures). CRI values above 80, while not as high as incandescent light sources, are generally considered to be sufficiently high for indoor lighting applications.

The light emitted from the light emitting arrangement has a correlated color temperature of approximately 2000 K at a relatively low luminous flux of approximately 50 lm. The light emitted from the light emitting arrangement has a correlated color temperature of approximately 3050 K at a relatively high luminous flux of approximately 1600 lm. Thus, at lower luminous flux, i.e. in the dimmed state, the correlated color temperature is relatively low. The present behavior of the dimmable light emitting arrangement is advantageous for the purpose of mimicking incandescent light sources, as the emitted light gets a reddish color in the dimmed state when the correlated color temperature shifts towards lower temperatures at a lower level of luminous flux compared to a higher level of luminous flux.

Further, the inventors investigated color points at different levels of luminous flux of the dimmable light emitting arrangement.

Figure 6:
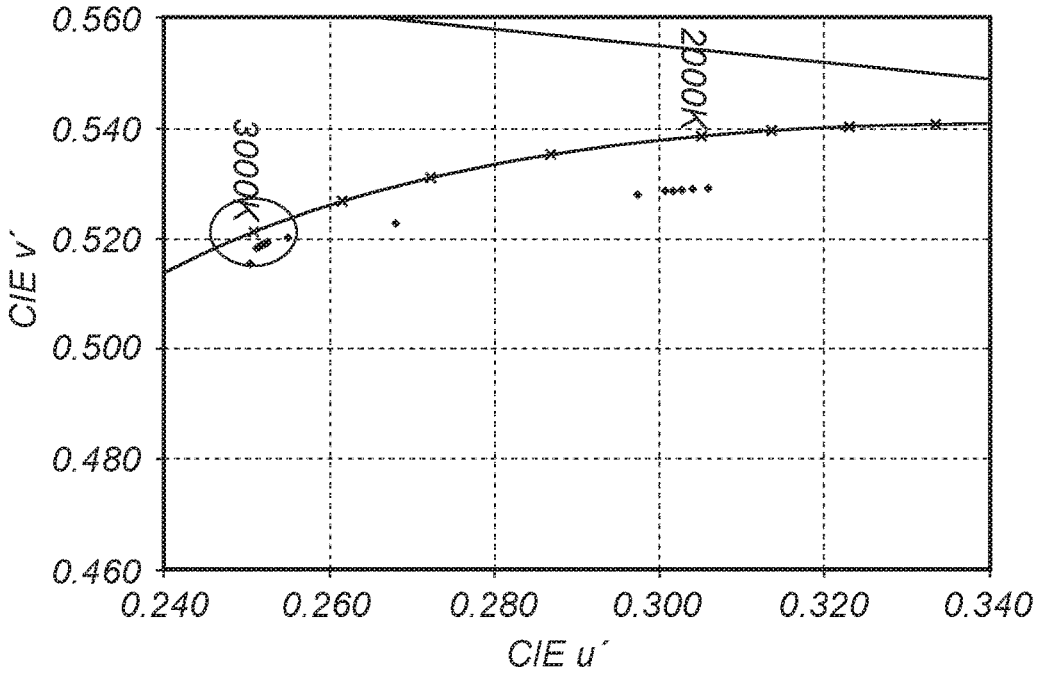
FIG. 6 shows a portion of the 1976 CIE chromaticity diagram including color points measured at different flux levels for a dimmable light emitting arrangement according to an embodiment of the present invention.

In FIG. 6, a CIE u'-v' diagram is shown including color points measured at different flux levels for a dimmable light emitting arrangement. The dimmable light emitting arrangement, being analyzed in FIG. 7, comprises a blue LED as the first light source, a phosphor-converted amber LED as the second light source, and a remote wavelength converting member comprising both LuAG and Lumogen F305, wherein LuAG is the first wavelength converting material and Lumogen F305 is the second wavelength converting material.

The CIE u'-v' diagram represents the color space as defined by the CIE in the year 1976. It is shown that the measured color points of the dimmable light emitting arrangement lie close to the line of an incandescent light source, indicating that the dimmable light emitting arrangement mimics the behavior of an incandescent light source well both at a relatively high level of luminous flux, e.g. in a full (undimmed) state, (where the CCT is about 3000 K), and at a relatively low level of luminous flux, i.e. in a dimmed state, (where the CCT is about 2000 K).

Further, the inventors investigated the intensity of different wavelengths at a low level of luminous flux and a high level of luminous flux, respectively, of the dimmable light emitting arrangement.

Figure 7:
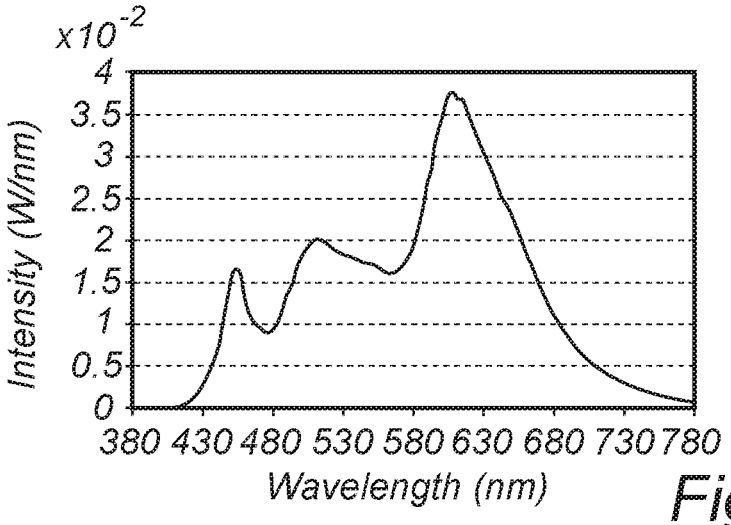
FIGS. 7-8 show a diagram of the measured spectra at a relatively high level of luminous flux, and a diagram of the measured spectra at a relatively low level of luminous flux, in a dimmable light emitting arrangement according to an embodiment of the present invention, respectively.
Figure 8:
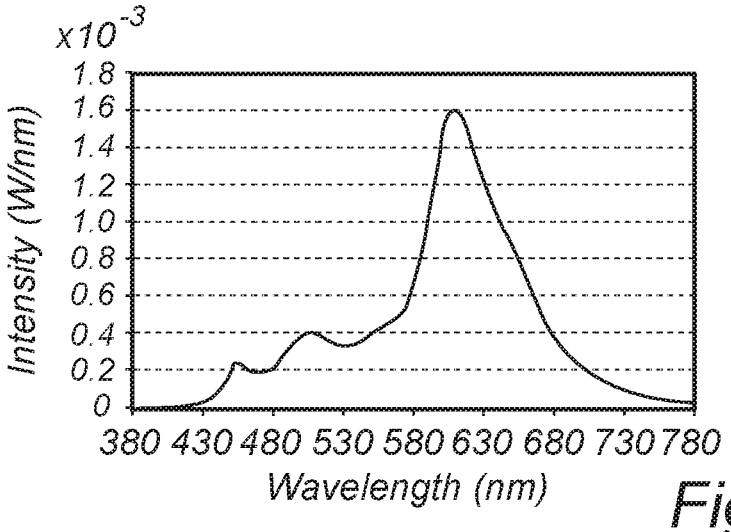

In FIGS. 7-8, diagrams of the measured spectra at two different levels of luminous flux are shown. In FIG. 7, a diagram of the measured spectra at a relatively high level of luminous flux (i.e. at about 1500 lm in the current example) is shown. In FIG. 8, a diagram of the measured spectra at a relatively low level of luminous flux (i.e. at about 50 lm in the current example) is shown.

The relatively low level of luminous flux is typically at about 1 to 5% of the relatively high level of luminous flux. Both at the relatively high level of luminous flux, and at the relatively low level of luminous flux, a peak in intensity is obtained at a wavelength within the range between approximately 590 nm and approximately 650 nm, and more specifically at a wavelength within the range between approximately from 595 nm and approximately 620 nm (corresponding to light appearing orange to the human eye). Thus, the emission of light appearing reddish to the human eye has a high intensity at both the relatively low level of luminous flux and at the relatively high level of luminous flux.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A dimmable light emitting arrangement comprising:

a first light source adapted to emit light of a first wavelength range between 380 and 460 nm, a second light source adapted to emit light of a second wavelength range between 570 and 610 nm, a unitary light exit window arranged remote from the first light source and the second light source;

a first wavelength converting material, arranged in the light exit window; and a second wavelength converting material, arranged in the light exit window;

wherein said first wavelength converting material is arranged to receive light emitted from said first light source and is configured to convert at least a portion of light emitted by said first light source having said first wavelength range into light having an emission peak within a third wavelength range between 470 and 570 nm, and wherein said second wavelength converting material is arranged to receive the light having the emission peak within the third wavelength range, and light emitted from said second light source, and is configured to convert both light of said third wavelength range and light of said second wavelength range into light having an emission peak within a fourth wavelength range between 590 and 630 nm, and to output white light comprising, at least in part, the converted light having an emission peak with the fourth wavelength range;

wherein said first light source and said second light source are dimmable between a first luminous flux and a second luminous flux, said first luminous flux being greater than said second luminous flux, wherein said output white light has a first color temperature associated with said first luminous flux and a second color temperature associated with said second luminous flux, said first color temperature being greater than said second color temperature.

2. A dimmable light emitting arrangement according to claim 1, wherein said second wavelength converting material is a red organic wavelength converting material.

3. A dimmable light emitting arrangement according to claim 1, further comprising a light mixing chamber, wherein said first light source and said second light source are arranged inside said light mixing chamber.

4. A dimmable light emitting arrangement according to claim 1, wherein each of said first light source and said second light source comprises at least one solid state light source.

5. A dimmable light emitting arrangement according to claim 1, wherein said first light source comprises at least one blue LED.

6. A dimmable light emitting arrangement according to claim 1, wherein said second light source comprises at least one phosphor-converted amber LED.

7. The dimmable light emitting arrangement according to claim 1, wherein the white light output further comprises light of said first wavelength range and light having an emission peak within said third wavelength range.

8. The dimmable light emitting arrangement according to claim 1, wherein said second wavelength converting material is further configured to convert the converted light having an emission peak with said third wavelength range into light having an emission peak within said fourth wavelength range.

9. A dimmable light emitting arrangement comprising:

a first light source adapted to emit light of a first wavelength range between 380 and 460 nm, a second light source adapted to emit light of a second wavelength range between 570 and 610 nm, a first wavelength converting member comprising a first portion including a first wavelength converting material and a second portion including a second wavelength converting material, wherein the second portion is disposed on top of the first portion, a second wavelength converting member including the second wavelength converting material;

wherein the first wavelength converting member is arranged remote from the second wavelength converting member and is configured to solely receive unconverted light emitted from the first light source, the first wavelength converting material of the first portion being configured to convert at least a portion of the light of the first wavelength range into light having an emission peak within a third wavelength range between 470 and 570 nm, wherein the second wavelength converting material of the second portion is configured to convert light of the first wavelength range into light having an emission peak within a fourth wavelength range between 590 and 630 nm, wherein the second wavelength converting member is arranged remote from the first wavelength converting member and is configured to solely receive unconverted light emitted from the second light source, the second wavelength converting material of the second wavelength converting member being configured to convert light of the second wavelength range into light having an emission peak within the fourth wavelength range.

10. The dimmable light emitting arrangement according to claim 9, wherein the first wavelength converting member is configured to transmit light of the first wavelength range.

11. The dimmable light emitting arrangement according to claim 9, wherein the second wavelength converting material of the second portion is further configured to convert the converted light having an emission peak with said third wavelength range into light having an emission peak within said fourth wavelength range.

* * * * *